US005727410A

United States Patent [19]

Hayashi et al.

[11] Patent Number: 5,727,410

[45] Date of Patent: Mar. 17, 1998

[54] PRESS-MOLDING OIL AND METHOD OF MANUFACTURING PRESS-MOLDED PRODUCTS BY USING THE SAME

[75] Inventors: Masao Hayashi, Shiga; Go Minami, Osaka; Kuniaki Matsunaga, Tochigi; Tsuyoshi Fujii, Tokyo; Takashi Hayashi, Chiba, all of Japan

[73] Assignee: Matsushita Electronics Corporation, Osaka, Japan

[21] Appl. No.: 725,767

[22] Filed: Oct. 4, 1996

Related U.S. Application Data

[62] Division of Ser. No. 608,447, Feb. 28, 1996.

[51] Int. Cl.[6] ..... B21B 45/02; B21B 45/00

[52] U.S. Cl. ..... 72/42; 72/46

[58] Field of Search ..... 72/41, 42, 46, 72/363, 379.2, 347, 352; 508/462, 463

[56] References Cited

U.S. PATENT DOCUMENTS

| | | | |
|---|---|---|---|
| Re. 34,914 | 4/1995 | Mizui et al. | 252/68 |
| 2,651,657 | 9/1953 | Mikeska et al. | 260/463 |
| 2,758,975 | 8/1956 | Cottle et al. | 252/49.8 |
| 3,332,980 | 7/1967 | Leary et al. | 260/463 |
| 4,062,312 | 12/1977 | Mason | 72/42 |
| 4,155,859 | 5/1979 | Higgins | 72/42 |
| 5,009,803 | 4/1991 | Brandolese | 252/49.5 |
| 5,370,809 | 12/1994 | Ishida et al. | 252/52 |

FOREIGN PATENT DOCUMENTS

| | | |
|---|---|---|
| 0 247 903 | 12/1987 | European Pat. Off. . |
| 0 393 749 | 10/1990 | European Pat. Off. . |
| 2154524 | 5/1973 | France . |
| 42 01 876 | 7/1993 | Germany . |
| 58-68149 | 4/1984 | Japan . |
| 6-73576 | 3/1994 | Japan . |
| 7-11273 | 1/1995 | Japan . |

*Primary Examiner*—Lowell A. Larson
*Assistant Examiner*—Rodney Butler
*Attorney, Agent, or Firm*—Merchant, Gould, Smith, Edell, Welter & Schmidt, P.A.

[57] ABSTRACT

In pressing and molding a shadow mask or the like, press-molding oil containing alkyl carbonate shown in the following Chemical Formula as an active ingredient is coated on a press mold. After pressing and molding a metallic material with the press mold, the press-molding oil is washed and removed with warm water. Alternatively, the oil is dried or thermally decomposed. As a result, less than about 10 $\mu g/cm^2$ oil is left as residue on the product.

(Chemical Formula)

$$R^1-(OH_{2a}C_a)_xO-\overset{\overset{\displaystyle O}{\|}}{C}O-(C_bH_{2b}O)_yR^2$$

where a and b are an integer from one to six; x and y are an integer from 0 to 30; $R^1$ and $R^2$ are an alkyl group, cycloalkyl group, alkylphenyl group, benzyl group or alkylbenzyl group having from one to thirty carbon atoms and straight or branched alkyl chains.

13 Claims, No Drawings

PRESS-MOLDING OIL AND METHOD OF MANUFACTURING PRESS-MOLDED PRODUCTS BY USING THE SAME

This is a Divisional of application Ser. No. 08/608,447, filed Feb. 28, 1996, which application(s) are incorporated herein by reference.

FIELD OF THE INVENTION

This invention relates to press-molding oil used in the production of products such as shadow masks of cathode-ray tubes, and a method of manufacturing press-molded products by treating the products with the oil. More specifically, this invention relates to a press-molding oil for cathode-ray tube members that can be removed without applying an organic solvent, and a method of manufacturing press-molded products by treating the products with the oil.

BACKGROUND OF THE INVENTION

Generally, press oil adheres to the surface of press-molded metallic products. For example, in the conventional method of press-molding shadow masks of cathode-ray tubes or the like, a deep drawing process is carried out on a 0.1–0.25 mm thick thin flat plate so as to form a curved surface. In this deep drawing process, lubricating oil is applied to reduce a load factor between a metallic mold and the flat plate during the molding process. It is known that mineral oil is widely used as a press oil, but an additive containing a compound of S, Cl or Si is generally added to the oil, thus reducing the load factor. Examples of such additives include sulfur-based ones such as olefin polysulfide, fat and oil sulfide or dialkyl polysulfide, chlorine-based ones such as chlorinated paraffin, phosphrous-based ones such as alkyl phosphate, aryl phosphite, complex-type ones such as an olefin hydrocarbon containing sulpur and chlorine, called chloronaphthazantate, or a product of olefin oligomer and phosphorus phosphite, organic metal salts such as lead naphthenic acid salt or zinc thiophasphate. When the additive remains on pressed surfaces, the additive will cause faults in the surfaces, such as stain, in a subsequent gas blackening process. Otherwise, even after an electron tube is evacuated in a process of manufacturing, the additive gradually volatilizes in the electron tube, and contaminates a cathod of the electron tube. The contamination deteriorates electron-emitting function, called emission, of the electron tubes. These negative effects are not found when the oil residue is less than about 10 $\mu g/cm^2$. As a result, a blackening process is carried out, producing good products without influencing blackening gas or emission. Press oil is removed generally by applying a chlorine-based organic solvent such as trichloroethane in conventional methods. However, chlorine-based organic solvents such as trichloroethane are not preferable for environmental conservation. Thus, a method of washing with a water-based cleaning agent applying higher alcohol was proposed (Published Unexamined (Kokai) Japanese Patent Application No. Hei 6-73576).

However, in Kokai Japanese Patent Application No. Hei 6-73576, a special water-based cleaning agent is applied, so that a manufacturing device becomes large and removal of press-molding oil becomes costly. Most significantly, when press-molding oil remains on shadow masks used for cathode-ray tube members of televisions or the like, negative effects are found on picture images.

SUMMARY OF THE INVENTION

It is an object of this invention to solve the above-mentioned conventional problems by providing a press-molding oil for cathode-ray tube members and a method of manufacturing press-molded products by applying the oil.

In order to accomplish this object, the press-molding oil of this invention comprises an alkyl carbonate shown in the following Chemical Formula 1 as an active ingredient.

$$R^1-(OH_{2a}C_a)_xO-\overset{\overset{\displaystyle O}{\|}}{C}O-(C_bH_{2b}O)_yR^2 \qquad \text{(Chemical Formula 1)}$$

wherein a and b are an integer between 1 and 6; x and y are an integer between 0 and 30; $R^1$ and $R^2$ are an alkyl group, cycloalkyl group, alkylphenyl group, benzyl group or alkyl benzyl group having from one to thirty carbon atoms and straight or branched chains.

The press-molding oil comprises the alkyl carbonate of 90 wt % or more as an active ingredient, more preferably 99 wt % or more. The press-molding oil can comprise a liquid ingredient in an amount of below 10 wt %. Examples of additional ingredients include mineral oils, higher alcohols having from six to thirty carbon atoms, aliphatic acids and water.

It is preferable that $R^1$ and $R^2$ in Chemical Formula 1 have from twelve to sixteen carbon atoms.

It is preferable that the press-molding oil comprises an antioxidant in an amount of 0.01 to 1 wt %.

It is preferable that the antioxidant is at least one selected from the group consisting of phenol-based antioxidants and aromatic amine-based antioxidants.

It is preferable that the antioxidant is at least one selected from the group consisting of 2,6-di-tert-butyl-p-cresol, 4,4'-methylenebis-(2,6-di-tert-butylphenol) and N-phenyl-α-naphthylamine.

One method of manufacturing press-molded products comprises the steps of coating a press-molding oil containing an alkyl carbonate shown in Chemical Formula 1 as an active ingredient on the surface of a press mold, pressing and molding a metallic material with the press mold, washing and removing the press-molding oil with warm water, and then drying the press-molded metallic material.

It is preferable that the warm water is from 40° C. to 80° C.

It is preferable that the metallic material is dipped in or sprayed with said warm water so as to remove the press-molding oil.

Another method of manufacturing press-molded products comprises the steps of coating press-molding oil containing alkyl carbonate shown in Chemical Formula 1 as an active ingredient on the surface of a press mold, pressing and molding a metallic material with the press mold, and heating the press-molded metallic material so as to evaporate or thermally decompose the press-molding oil.

It is preferable that the press-molded metallic material is heated from 100° C. to 600° C.

It is preferable that the press-molded metallic material is heated in an atmosphere comprising at least one gas selected from the group consisting of CO, $CO_2$ and other non-oxidizing gasses.

It is also preferable in the methods that the press-molded products are cathod-ray tube members, specifically shadow masks to be used for cathode-ray tubes, prior to application of a blackening process.

It is also preferable in the methods that the press-molding oil is coated on the surface of the press mold in a density of 2 $g/m^2$ to 10 $g/m^2$, more preferably 2.3 $g/m^2$ to 7 $g/m^2$.

It is also preferable in the methods that the press-molding oil comprises an antioxidant of 0.01 to 1 wt %.

It is also preferable in the methods that the antioxidant is at least one selected from the group consisting of phenol-based antioxidants and aromatic amine-based antioxidants.

It is also preferable in the methods that the antioxidant is at least one selected from the group consisting of 2,6-di-tert-butyl-p-cresol, 4,4'-methylenebis-(2,6-di-tert-butylphenol) and N-phenyl-α-naphthylamine.

Since the press-molding oil of this invention comprises alkyl carbonate shown in Chemical Formula 1 as an active ingredient, residual press-molding oil can be easily removed without reducing press-molding properties. As a result, the press-molding oil does not remain or provide negative effects on picture image properties when the oil is applied to shadow masks of cathode-ray tube members of televisions or the like.

Residual press-molding oil is easily removed without reducing press-molding properties when $R^1$ and $R^2$ in Chemical Formula 1 have from twelve to sixteen carbon atoms.

When the press-molding oil of this invention contains an antioxidant of 0.01 to 1 wt %, the antioxidant inhibits oxidation in the oil, preventing corrosion or abrasion in metal materials and generating insoluble sludge in the oil. The antioxidants having an effect of terminating chain reaction are preferable. Examples of such antioxidants as chain terminator include phenol-based antioxidants and aromatic amine-based antioxidants, specifically 2,6-di-tert-butyl-p-cresol, 4,4'-methylenebis-(2,6-di-tert-butylphenol) and N-phenyl-α-naphthylamine.

In the first method of manufacturing press-molded products, the oil residue is less than about 10 μg/cm$^2$.

When the metallic material is dipped in or sprayed with warm water at 40°–80° C., the press-molding oil is efficiently removed.

In the second method of manufacturing press-molded products, oil residue is less than about 10 μg/cm$^2$.

Since the press-molded metallic material is heated at 100°–600° C. in an atmosphere containing at least one gas selected from the group consisting of CO, $CO_2$ and other non-oxidizing gasses, the press molding oil is efficiently removed. Examples of the non-oxidizing gasses include $N_2$, Ar and He; In particularly $N_2$ is oxidizing gasses include $N_2$, Ar and He; In particularly $N_2$ is industrially preferable.

The methods of the invention are applicable to press any products, for example, cathod-ray tube members, electric or electronic components, or parts for machines or automobiles.

When shadow masks of cathode-tube wires are manufactured in the first or second method of the invention, the press-molding oil is removed before a gas blackening process, thus providing preferable blackening layers.

A preferable density of the press-molding oil for shadow masks having an area of about 0.24 m$^2$ for a 29-inch TV set is from 0.5 to 1.5 g/m$^2$.

DETAILED DESCRIPTION OF THE INVENTION

This invention will be described by referring to the following illustrative examples.

EXAMPLE 1

A press-molding oil manufactured by Mitecs Corporation (LIALCARB SR-1000/VR; colorless-or light yellow transparent liquid; 40° C. viscosity; 17.0 centistokes; 240° C. flash point) was used. The oil comprised 99.9 wt % alkyl carbonates and 0.01 wt % antioxidant. The alkyl carbonates used were a mixture of long chain alkyl carbonates having from twelve to sixteen carbon atoms for $R^1$ and $R^2$ shown in Chemical Formula 1. The antioxidant was a chain reaction terminator, 2,6-di-tert-butyl-p-cresol.

About 1 g of the press-molding oil was coated on one shadow mask press mold or shadow mask plate for pressing and molding a shadow mask having an area of about 0.24 m$^2$ for a 29-inch TV set, and the plate was then pressed and molded. It was more efficient and preferable to coat the oil onto the surface of the mask press mold than that of the mask plate. As a result, a predetermined preferable molded and curved surface with no galling break was formed. Then, the surface was treated so as to form an $Fe_3O_4$ film (gas blackening process), thus preventing oxidation and providing preferable thermal radiation. However, if the press-molding oil is still adhered on the surface, $Fe_3O_4$ film cannot be formed and a furnace may be damaged by baking the plate in it during the gas blackening process. Therefore, warm water (40°–80° C. and 100–200 kPa water pressure) was then sprayed onto the entire surface of the plate for about three minutes. The amount of warm water was about 20 liters. Applying warm water of 40°–80° C. was most economical. The plate was then dried.

As a result, a preferable $Fe_3O_4$ film was formed without damage to a furnace. The provided shadow masks were incorporated to a TV set in the conventional method, and electron-emitting function, called emission, of the electron tube was measured in the TV set. It was not found that electron-emitting function in the electron tube was deteriorated.

EXAMPLE 2

The same processes as in Example 1 were followed, except that the process of removing the press-molding oil with a warm water shower was replaced with a process of removing the oil with ultrasonic waves in a container containing warm water. The shadow mask was dipped and held in warm water for three minutes. Then, the water was removed by drying the mask.

As a result, a preferable $Fe_3O_4$ film was formed without damage to a furnace. The provided shadow masks were incorporated to a TV set in the conventional method, and electron-emitting function, called emission, of the electron tube was measured in the TV set. It was not found that electron-emitting function in the electron tube was deteriorated.

EXAMPLE 3

The same processes as in Example 1 were followed, except that the process of removing the press-molding oil with a warm water shower was replaced with a process of thermally decomposing the oil in an atmosphere containing 0–1.5 vol % CO, about 12 vol % $CO^2$ and the rest volume percent of an inert gas, $N_2$ at about 350° C. A thermally decomposing for 3–10 min at 350°–380° C. was found preferable. Decomposing for 10 min at 350° C., or for 3 min at 380° C. was found more preferable. Since metal oxidation occurs in normal air, the mold should be treated in CO, $CO_2$ or $N_2$.

As a result, a preferable $Fe_3O_4$ film is formed without damage to a furnace. The provided shadow masks were incorporated to a TV set in the conventional method, and electron-emitting function, called emission, of the electron tube was measured in the TV set. It was not found that electron-emitting function in the electron tube was deteriorated.

EXAMPLE 4

The same processes as in Example 1 were followed, except that the antioxidant, 0.01 wt % 2,6-di-tert-butyl-p-cresol in the oil was replaced with 0.01 wt % 4,4'-methylenebis-(2,6-di-tert-butylphenol).

As is in Example 1, a preferable $Fe_3O_4$ film was formed without damage to a furnace. The provided shadow masks were incorporated to a TV set in the conventional method, and electron-emitting function, called emission, of the electron tube was measured in the TV set. It was not found that electron-emitting function in the electron tube was deteriorated.

EXAMPLE 5

The same processes as in Example 1 were followed, except that the antioxidant, 0.01 wt % 2,6-di-tert-butyl-p-cresol in the oil was replaced with 0.01 wt % N-phenyl-α-naphthylamine.

As is in Example 1, a preferable $Fe_3O_4$ film was formed without damage to a furnace. The provided shadow masks were incorporated to a TV set in the conventional method, and electron-emitting function, called emission, of the electron tube was measured in the TV set. It was not found that electron-emitting function in the electron tube was deteriorated.

As explained above, the press-molding oil of the invention is readily removable, providing shadow masks having a preferable molded and curved surface free of oil residue. When the press oil is used in pressing cathod-ray tube members for TV sets, such as shadow masks, the press oil does not remain on the shadow mask or deteriorate picture images properties.

The invention may be embodied in other forms without departing from the spirit or essential characteristics thereof. The embodiments disclosed in this application are to be considered in all respects as illustrative and not restrictive, the scope of the invention is indicated by the appended claims rather than by the foregoing description, and all changes which come within the meaning and range of equivalency of the claims are intended to be embraced therein.

What is claimed is:

1. A method of manufacturing a shadow mask for a cathode ray tube, comprising:

coating a surface of a press mold for a shadow mask for a cathode ray tube with a press-molding oil comprising an alkyl carbonate shown in the following Formula A:

$$R^1-(OC_aH_{2a})_xO-\overset{\overset{\displaystyle O}{\|}}{C}O-(C_bH_{2b}O)_yR^2 \quad \text{(Chemical Formula A)}$$

wherein a and b independently are an integer from 1 to 6; x and y independently are an integer from 0 to 30, and $R^1$ and $R^2$ independently are selected from the group consisting of alkyl, cycloalkyl, alkylphenyl, benzyl or alkylbenzyl having from one to thirty carbon atoms, with the alkyl chains being straight or branched;

pressing and molding a metallic material with said coated press-mold to form the metallic material into a shadow mask for a cathode-ray tube; and removing the press-molding oil from the metallic material press-molded into the form of a shadow mask by (a) washing the press-molded shadow mask with warm water followed by drying the press-molded shadow mask, or (b) heating the press-molded shadow mask so as to evaporate or thermally decompose the press-molding oil.

2. The method according to claim 1, wherein the press-molded shadow mask is subjected to a gas blackening process after removal of the press-molding oil.

3. The method according to claim 1, wherein the press-molding off is coated on the surface of the press-mold in a density from 2 g/m$^2$ to 10 g/m$^2$.

4. The method according to claim 1, wherein the press-molding oil comprises an antioxidant in an amount of 0.01 to 1 wt %.

5. The method according to claim 1, wherein the press-molding oil is removed from the press-molded shadow mask with warm water, the warm water being at a temperature from 40°–80° C.

6. The method according to claim 1, wherein the press-molding oil is removed from the press-molded shadow mask by dipping the shadow mask in the warm water or spraying the shadow mask with the warm water so as to remove the press-molding oil.

7. The method according to claim 1, wherein the press-molding oil is removed from the press-molded shadow mask by heating the shadow mask at a temperature of 100°–600° C.

8. The method according to claim 1, wherein the press-molding oil is removed from the press-molded shadow mask by heating the shadow mask in an atmosphere comprising at least one gas selected from the group consisting of non-oxidizing gases.

9. The method according to claim 1, wherein the press-molding oil is removed from the press-molded shadow mask by heating the shadow mask in an atmosphere comprising at least one gas selected from the group consisting of carbon monoxide and carbon dioxide.

10. The method according to claim 1, wherein the press-molding oil is removed from the press-molded shadow mask to a level less than about 10 μg/cm$^2$.

11. The method according to claim 2, wherein the press-molding oil is coated on the surface of the press-mold in a density from 2.3 g/m$^2$ to 7 g/m$^2$.

12. The method according to claim 4, wherein the antioxidant is at least one selected from the group consisting of phenol-based antioxidants and aromatic amine-based antioxidants.

13. The method according to claim 4, wherein the antioxidant is at least one selected from the group consisting of 2,6-di-tert-butyl-p-cresol, or 4'-methylenebis-(2,6-di-tert-butylphenol) and N-phenyl-α-naphthylamine.

* * * * *